United States Patent [19]

Garnier

[11] Patent Number: 4,609,155

[45] Date of Patent: Sep. 2, 1986

[54] SHREDDING APPARATUS INCLUDING OVERLOAD PROTECTION OF DRIVE LINE

[75] Inventor: Thomas J. Garnier, Portland, Oreg.

[73] Assignee: Shredding Systems, Inc., Wilsonville, Oreg.

[21] Appl. No.: 721,473

[22] Filed: Apr. 9, 1985

[51] Int. Cl.[4] ..... B02C 25/00

[52] U.S. Cl. ..... 241/30; 241/36; 241/101.2; 241/236

[58] Field of Search ..... 464/23, 30, 160, 161; 241/30, 32, 36, 101.2, 236

[56] References Cited

U.S. PATENT DOCUMENTS

| | | | |
|---|---|---|---|
| 321,656 | 7/1885 | Stolterfoht | 192/53 B |
| 2,702,619 | 2/1955 | Andershock | 192/85 |
| 2,940,283 | 8/1955 | Christenson | 64/30 |
| 3,122,903 | 3/1964 | Ramsden | 64/30 |
| 3,600,877 | 8/1971 | McCrary et al. | 56/10.3 |
| 4,052,013 | 10/1977 | Ehrlich et al. | 241/101.2 |
| 4,452,400 | 6/1984 | Williams | 241/36 |
| 4,464,137 | 8/1984 | Jennings | 464/48 |
| 4,496,105 | 1/1985 | Fleming et al. | 241/32 |

*Primary Examiner*—Mark Rosenbaum

*Attorney, Agent, or Firm*—Chernoff, Vilhauer, McClung & Stenzel

[57] ABSTRACT

Apparatus and method for its use for protecting an electric motor and the mechanical drive line of a material comminuting machine of the type having intermeshing overlapping cutters on rotary shafts, against damage caused by overloading. A torque-limiting coupling located in the drive line between the motor and the cutter shafts is provided with rotation sensors on both the input and output sides of the torque-limiting coupling. A motor controller is responsive to significant differences in the amounts of rotation of the input and output sides of the torque-limiting coupling to stop the motor in case of excessive slippage, in order to protect the motor and the torque-limiting coupling. Where a current-sensing overload device is provided in the case of use of the device with an electric motor, the motor controller can be programmed to respond with sensitivity different from that of the electrical overload protection device.

11 Claims, 2 Drawing Figures

SHREDDING APPARATUS INCLUDING OVERLOAD PROTECTION OF DRIVE LINE

BACKGROUND OF THE INVENTION

The present invention relates to material comminuting machines, and particularly to a shredding machine including improved devices for protecting against damage caused by mechanical shock or overloading of the apparatus.

It is well known for shredding machines to include rotating shafts carrying intermeshed cutters which act against one another to shear material into smaller pieces. Typically, such apparatus includes a cutter box housing the cutters, which are mounted fixedly on counterrotating parallel shafts oriented horizontally, with a feed hopper being located above the cutter box. Material to be comminuted is placed into the feed hopper, where gravity forces it into the proper location to be engaged by the cutters and be torn or cut into small pieces. Frequently, when shredding industrial waste materials such as metal scrap, or when comminuting used automobile tires and the like, the cutting mechanisms are obstructed, at least temporarily, when material too tough or large to be shredded, or in too great a quantity at any one time, becomes lodged between opposing ones of the cutters. If a hard object is the cause of blockage, a significant mechanical shock can be received by the driving shafts and reduction gears of the mechanism, potentially damaging or weakening the drive line of the apparatus.

When such shredders are driven by an electric motor, the electrical current drawn by the motor is often monitored, and the motor is automatically shut down in the case of excessive current, as when the mechanism is blocked, in order to protect against burnout. Devices such as shear pins have been used to protect such shredders and their drive lines against mechanical shock which might otherwise apply excessive amounts of torque to portions of the mechanism.

A common first step in clearing a blockage of the shredding machine is to reverse the rotation of the cutter shafts temporarily in order to provide an additional chance to cut through the material. Repeated attempts to clear blockages in this way may result in cumulative damaging effects from numerous short periods of electrical overloading of the motor. Additionally, if the blockage is caused by material which abruptly stops the cutter mechanism, there may be excessive torque felt by some parts of the mechanism.

Operation of a shredding machine to shred materials which provide frequent mechanical shocks may impose loads greater than the normally-experienced loads, yet of short enough duration that an electrical overload prevention device associated with the motor power supply does not shut down the shredder. This may eventually result in overheating and damage to the motor windings, resulting in expensive down-time for the shredding machine.

What is needed, therefore, is an improved protective device for preventing a shredding machine from damaging itself during extended periods of operation while shredding materials which apply heavy stress to the shredding mechanisms. Preferably, such a protective device could be used to complement electrical overload protection in a shredder driven by an electric motor, and to provide protection against damage of a torque-limiting coupling in a shredding machine driven by either an electric motor or another motor, such as a hydraulic motor.

While it is possible to incorporate a torque-limiting device in the drive line of such a shredding machine, devices used to protect against current overloads in the motor driving such a shredding machine normally allow a high current to pass for a certain amount of time, which may be enough to result in significant damage to a slipping torque-limiting coupling.

Such a torque-limiting coupling typically is adjustable compensate for wear resulting from occasional slippage. Nevertheless, excessive and continuous slippage can result in rapid wear of the friction lining material, and may damage the material irreparably.

SUMMARY OF THE INVENTION

The present invention overcomes some of the shortcomings of previously used devices for protecting the motor and mechanical portions of a waste shredder from damage resulting from overloading and mechanical shock, by providing a torque-limiting coupling in the drive line between the motor and the cutter mechanism, and a control system which automatically stops operation of the shredding machine in response to excessive slippage of a torque-limiting coupling.

According to the present invention the amounts of rotation of portions of the drive line of a mechanical shredding machine are observed, separately, on the input and output sides of a torque-limiting coupling in the drive line. For example, by using well known devices which cause electrical pulses to be produced in response to movement of a magnet past a sensor fixedly mounted with respect to the machine, the rotation of the shaft may be observed on both the input and the output sides of a torque-limiting coupling. By comparison between the amounts of rotation on the two sides of the torque-limiting coupling, a properly-programmed microcomputer can be used according to the present invention to determine the amount of slippage which is occurring during operation of the shredding machine including the present invention. When a predetermined difference is observed, between the amounts of rotation of the input and output portions of the drive line through the torque-limiting coupling, the shredder is stopped automatically to prevent damage. Well known programming techniques may be used to define the amount of slippage which may be permitted to occur without shut-down of the shredder.

For example, a large amount of slippage occurring over a short time, for example one second or less, may be used as a main parameter requiring shut-down, while continuous slippage of a much smaller degree, for example, 10 percent slippage, over a longer duration, may also require shut-down of the shredder to protect the drive line, particularly the torque-limiting coupling.

In shredding machines driven by electric motors having overload protection, the protection provided by the present invention may be utilized in conjunction with and to supplement electrical overload protection, providing a quicker response to overloading caused by abrupt mechanical stoppage of the cutters. The device receiving the signals representative of the rotation of the parts of the drive line may be programmed to recognize increasing amounts of slippage in the torque-limiting coupling, or to recognize the long-term results of loading less than that which would cause the electrical overload protection to operate, yet large enough to cause an undesirable amount of overheating in the shredder motor.

It is therefore a primary object of the present invention to provide an improved protective device for use with material comminuting machines to protect against mechanical overloading and damage to torque-limiting couplings used in such machines.

It is another important object of the present invention to provide apparatus for protecting a shredding machine against damage caused by overloading occurring over a moderately extended period of time, rather than a very short period.

A primary feature of the present invention is a device for observing the rotation of drive line components on both an input and output side of a torque-limiting coupling located in the drive line of a mechanical shredder, in order to detect excessive loading of the shredder and stop operation of its drive motor before damage is caused.

It is another feature of the present invention that it may be used to respond to overloading occurring both instantaneously and over an extended period of time.

It is an important advantage of the present invention that it provides a previously unavailable device for protecting a torque-limiting coupling against damage resulting from sudden slippage under load.

DETAILED DESCRIPTION OF THE INVENTION

Figure 1:
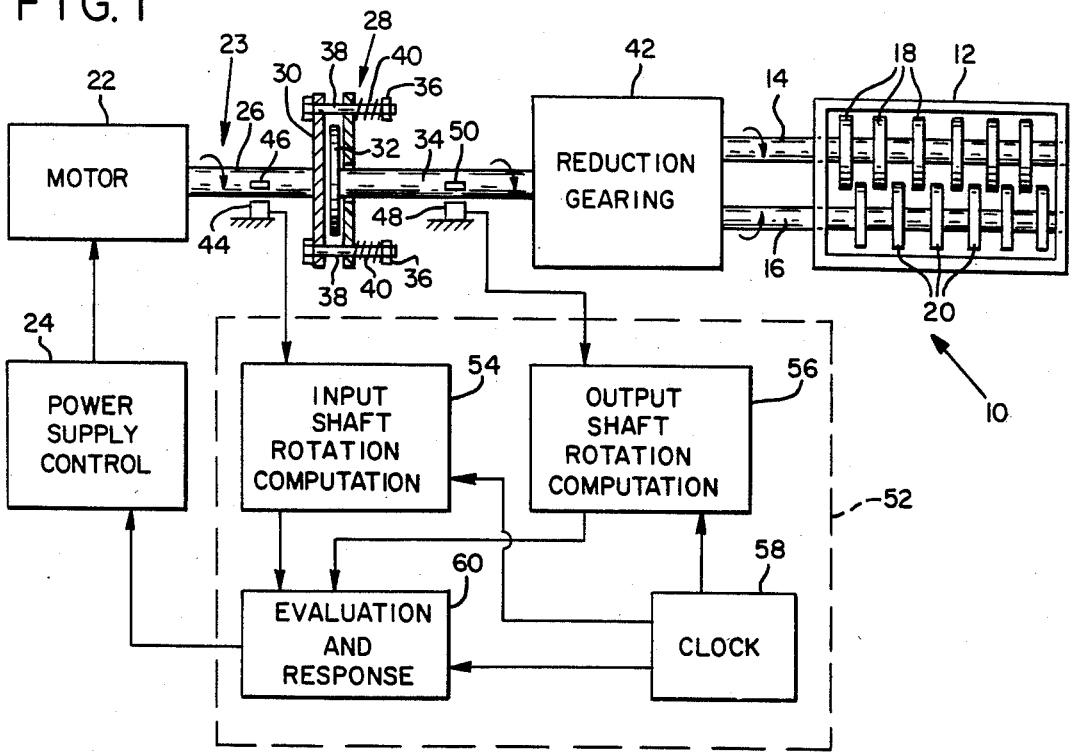
FIG. 1 is a block diagram of a materials shredding apparatus embodying the present invention.

Referring now to the drawings, in FIG. 1, a shredder 10 embodying the present invention includes a cutter box 12, in which a pair of counterrotating shafts 14 and 16 are suitably supported for rotation. Spaced apart along the shafts 14 and 16 are respective disc-like cutters 18 and 20, mounted on the shafts 14 and 16 for rotation therewith. The cutters 18 and 20 overlap one another, and by their counterrotation, draw material between the shafts 14 and 16 and shred or tear the material into smaller pieces. Shredders of this type are well known and may include cutters of many different types, the details of which do not form a part of the preseht invention.

A motor 22, which may be of any suitable type capable of providing the required amount of power and torque, is provided with its source of power through a power supply control unit 24, which may be an electrical motor controller, or a hydraulic pressure control valve, or other type of control, depending upon the type of the motor 22.

The motor 22 includes a shaft which is connected drivingly to the cutter box 12 through a drive line 23. A power input shaft 26 is driven by the shaft of the motor 22. A torque-limiting coupling 28 included in the drive line 23 has a driving portion 30 which is fixedly attached to the power input shaft 26. A driven portion 32 of the torque-limiting coupling 28 is fixedly attached to a power output shaft 34, and is driven rotatingly by frictional contact between the driving portion 30 and the driven portion 32. The amount of torque which can be transmitted through the torque-limiting coupling 28 is adjustably determined by means, for example, of spring compression, which can be adjusted by tightening nuts 36 on spring retaining bolts 38, to adjust the amount of compression of springs 40. Torque-limiting couplings are well known, and a suitable torque-limiting coupling for the present purpose is commercially available, for example, from the Falk Corporation, of Milwaukee, Wisconsin. It would also be possible to utilize one or more additional motors, and to use a separate torque-limiting coupling associated with each motor.

The power output shaft 34 is connected drivingly to the cutter box 12 through reduction gearing 42, also part of the drive line 23. The reduction gearing drives the cutter shafts 14 and 16 at the appropriate rotational speed when driven by the motor 22 through the torque limiting coupling 28.

Since it is possible that, during the course of shredding material, foreign material or a piece of the material being shredded which is too large for the capacity of the cutter box 12 may become lodged between opposing ones of the cutters 18 and 20, it is desirable to protect the shredder 10 against damage caused by overloading and the shock of abruptly encountering foreign objects between the cutters 18 and 20. This is accomplished by adjusting the amount of torque which can be transmitted through the torque-limiting coupling 28 to a value which can be accepted safely by the components of the shredder 10. It is possible, then, safely to operate a shredder such as the shredder 10 by manually operating the power supply control 24 to stop the motor 22 when the torque-limiting coupling 28 begins to slip noticeably, or when the motor 22 is stalled by foreign matter in the cutter box 12.

However, it is also desirable to protect the torque-limiting coupling 28 against unacceptable wear. This is accomplished according to the present invention by observing separately the amounts of rotation of the input shaft 26 and the output shaft 34, to determine the amount of slippage occurring in the torque-limiting coupling 28. To this end, a rotation detecting device such as a proximity switch 44 is mounted on the shredder 10 in a stationary location adjacent the input shaft 26, in order to observe the amount of rotation of the input shaft 26. For example, the rotation detector 44 may be a magnetically-actuated proximity switch. To operate the proximity switch, a permanent magnet 46 is mounted fixedly on the input shaft 26 for rotation therewith in order to provide an impulse to the rotation detector 44 indicative of rotation of the input shaft 26. Similarly, a rotation detector 48, which like the rotation detector 44 may be a magnetically-actuated proximity switch, is fixedly located on the shredder 10 to detect rotation of the output shaft 34. A magnet 50 is fixedly mounted on the output shaft 34 for rotation therewith in order to trigger the rotation detector 48 and provide an indication of rotation of the output shaft 34. It will be understood that the specific type of rotation detector to be used is a matter of some choice, and that more than one magnet such as the magnets 46 and 50 may be used with a magnetic proximity switch to provide a more precise indication of the amounts of rotation of the shafts 26 and 34.

A control unit 52 is responsive to the rotation detectors 44 and 48 to control operation of the motor 22 in response to detection of excessive slippage in the torque-limiting coupling 28. Within the control units 52, which may include an appropriately-programmed microcomputer, a signal produced by the rotation detector 44 is processed in an input shaft rotation computation section 54 to determine the amount and speed of input shaft rotation. Similarly, an output shaft rotation computation section 56 computes the amount and speed of the rotation of the output shaft 34. A clock section 58 provides time signals to the input and output shaft rotation computation section 54 and 56 and to an evaluation and response section 60, which compares the amounts of rotation of the input shaft 26 and output shaft 34, in order to determine the amount of slippage which occurs. Upon determination that slippage is occurring in an amount greater than that determined to be acceptable, the evaluation and response section 60 will cause the power supply control 24 to stop the motor 22.

It will be understood that the input shaft rotation computation section 54, output shaft rotation computation section 56, clock 58, and evaluation and response section 60 may all be embodied in a single, appropriately programmed microcomputer, and need not be physically separate from one another, so long as the required functions are performed.

Preferably, the controller 52 will be set up to provide a signal from the evaluation and response section 60 to the power supply control 24 which will cause the power supply control 24 to reverse the direction of the motor 22 temporarily upon sensing a predetermined amount of slippage in the torque-limiting coupling 28 for at least a predetermined amount of time. For example, slippage of an amount equal to or greater than 10% of the amount of rotation of the input shaft 26 for a period of time equal to or greater than one-half second could be used as a parameter in response to which the power supply control 24 would cause the motor 22 to operate in reverse for a period of, for example, two seconds, after which the motor 22 would return to its usual direction of rotation to attempt to continue operation of the shredder 10 in its normal fashion. The controller 52 is preferably programmed to provide such a response to slippage a predetermined number of times, for example, three times. In response to continued slippage above the predetermined amount and duration thereafter, the evaluation and response section 60 would, preferably, provide a signal to the power supply control 24 to interrupt the supply of power to the motor 22, so that the cause of the slippage could be investigated and corrected.

Acceptable amounts of slippage of the torque-limiting coupling and acceptable amounts of time during which such slippage is permitted to occur without response are chosen to permit minor amounts of slippage of the torque-limiting coupling 28, in order to accommodate the amounts of shock of the drive line 23 caused by encountering large pieces of material which are within the capacity of the shredder 10, but to stop the motor 22 in the cause of continued slippage indicating that the torque-limiting coupling 28 may have become worn.

Continued slippage in the torque-limiting coupling 28 could eventually result in slow-down or stoppage of the output shaft 34 while the input shaft 26 continues to rotate at or near its rated speed. This is likely to cause serious damage to the frictional linings of the torque-limiting coupling 28. It is therefore important to stop the motor 22 so that the torque-limiting coupling 28 can be adjusted, before the amount of slippage becomes excessive. It is thus desirable to program the evaluation and response section 60 to respond to slippage of a long duration which is of a small percentage, for example, 10% of the amount of rotation of the input shaft 26, while a nearly complete stoppage of the output shaft 34 for a very short time, e.g. 0.1 second, may be tolerable, as a response to the cutters 18 and 20 encountering an unusually tough, yet managable, piece of material. It is intended that the torque-limiting coupling 28 should slip in the latter situation in order to protect the entire drive line 23.

Figure 2:
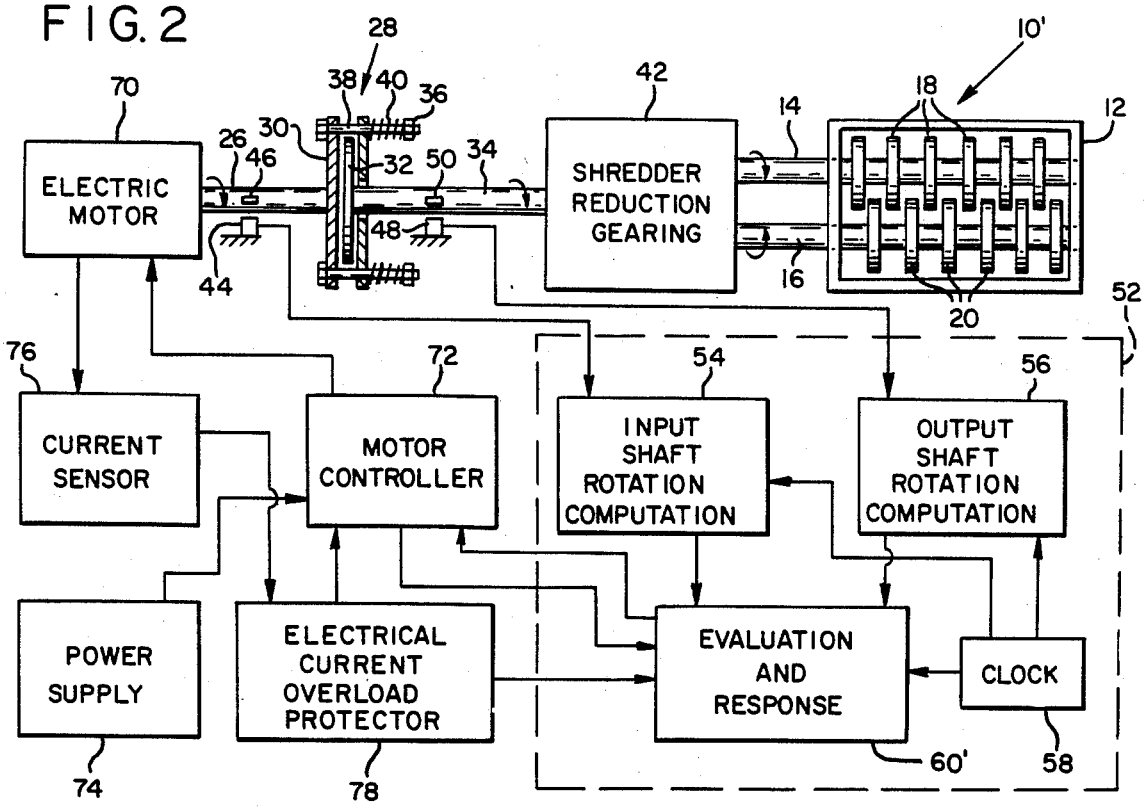
FIG. 2 is a block diagram of a materials shredding apparatus similar to that shown in FIG. 1, driven by an electric motor having overload protection.

Referring now to FIG. 2, a shredder 10' which includes a second embodiment of the invention is similar, in general, to the embodiment depicted in FIG. 1. In FIG. 2, an electric motor 70 is used as the prime mover of the shredder 10', and a motor controller 72 controls electrical power received from a power supply 74. A current sensor 76 senses the amount of current provided at any particular time to the motor 70. An indication of the amount of current is provided to an electrical current overload protector 78, which may actually include the current sensor 76, although they are shown separately in FIG. 2 for the sake of clarity. An indication of the amount of current is provided by the overload protector 78 to the evaluation and response section 60' of the control unit 52.

The electrical current overload protector 78 is connected to the motor controller 72 and provides a signal to the motor controller 72 which causes the motor controller 72 to reverse the motor 70 temporarily in response to a current overload indicative of jamming or blockage of the cutters 18 and 20, so that current is not permitted to pass at an excessive level for an amount of time likely to cause damage to the motor 70. Should temporary reversal of the motor 70 as a response to the electrical current overload protector 78 be unsuccessful after a predetermined number of attempts, the evaluation and response section 60' will cause the motor controller 72 to interrupt the supply of power to the motor 70 in order to permit inspection and correction of the blockage in the cutter box 12.

The typically available electrical current overload protector 78 will not respond as quickly as is desirable in the event of stoppage of the shafts 14 and 16. It is desirable, therefore, for the evaluation and response section 60' to respond primarily to the amount of slippage of the torque-limiting coupling 28, as detected by the difference between the respective amounts of rotation of the power input shaft 26 and the power output shaft 34, as described previously in connection with the embodiment of the invention shown in FIG. 1. Such a response can occur much more quickly, if the control unit 52 is programmed acordingly, so that slippage of the torque-limiting coupling 28 is minimized consistent with normal operation.

Additionally, it is desirable for the evaluation and response section 60' to be programmed to respond to unusually large electrical current loading which continues over a long period of time, even though such current is not sufficient to trip the electrical current overload protector, or alternatively, in order to stop the motor 70 in case of failure of the electrical current overload protector 78. Thus the shredder 10' includes redundancy in the protection provided against damage from overloading and mechanical blockage or shock resulting from materials beyond the capacity of the cutters 18 and 20. As a result, slippage may be permitted to occur in the torque-limiting coupling 28 in response to mechanical shock caused by encountering individual large pieces of material which are, nevertheless, sheared by the cooperation of the cutters 18 and 20. Nevertheless, the torque-limiting coupling 28 is protected by detection of excessive amounts of slippage between the input shaft 26 and the output shaft 34. Such a response to slippage in the torque-limiting coupling 28 occurs, in accordance with the present invention, more quickly than the electrical current overload protector 78 responds to stoppage or overloading of the motor 70, and thus protects the torque-limiting coupling 28, itself, from irreparable damage to its frictional lining, which might be caused by excessive slipping which would not result in an electrical overload.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for comminuting materials comprising at least one pair of rotatable cutter shafts equipped with fixedly mounted rotary cutters which cooperatively interact to shred material, including:

(a) a drive motor having a shaft;

(b) a drive line interconnecting said drive motor shaft with at least one of said cutter shafts, for rotating the cutter shaft in response to rotation of said motor shaft; and (c) a torque-limiting coupling included in said drive line, said torque-limiting coupling permitting slippage between said cutter shaft and said drive motor shaft, to prevent transmission of torque greater than a predetermined value;

(d) first rotation sensing means for sensing the amount of rotation of a first part of said drive line located between said drive motor and said torque-limiting coupling;

(e) second rotation sensing means for sensing the amount of rotation of a second part of said drive line located between said torque-limiting coupling and said at least one of said cutter shafts; and (f) automatic means for comparing the amounts of rotation of said first and second parts of said drive line and automatically temporarily reversing the direction of rotation of said drive motor in response to a predetermined difference between the respective amounts of rotation of said first and second parts of said drive line within a first predetermined period of time.

2. The apparatus of claim 1 wherein said drive motor is an electric motor, further including means responsive to the amount of electric current drawn by said drive motor, for disconnecting the source of power from said drive motor in response to motor current above a predetermined level for more than a second predetermined period of time.

3. The apparatus of claim 1, further comprising counting means for counting the number of times the direction of rotation of said drive motor is reversed and automatic means responsive to said counting means, for disconnecting said power source in response to reversing said direction of rotation temporarily a predetermined number of times within a second predetermined time.

4. The apparatus of claim 1 wherein said first and second rotation sensing means comprise magnetically-actuated proximity devices and permanent magnet means for moving a respective magnetic field past each of said proximity devices during rotation of said first and second parts of said drive line, respectively.

5. The apparatus of claim 1 including drive motor current sensing means for detecting excessive drive motor current, clock circuit means for providing a timing signal, and automatic means for evaluating motor current, the amount of rotation of said first part of said drive line, and the amount of rotation of said second part of said drive line, and temporarily reversing the direction of rotation of said drive motor means in response to a combination of drive motor current above a predetermined intensity, together with a predetermined difference between the amounts of rotation of said first part of said drive line and said second part of said drive line, during a second predetermined period of time.

6. A method of protecting a material-comminuting machine having at least a pair of rotary cutter shafts driven by a motor connected drivingly with said cutter shafts by a drive line, the method comprising:

(a) providing a torque-limiting coupling in said drive line;

(b) limiting the amount of torque transmitted by said motor to a cutter shaft of said material comminuting machine and permitting slippage of said torque-limiting coupling between said motor and said cutter shaft in response to a load placed on said cutter shaft in excess of a predetermined amount of torque;

(c) monitoring the amount of slippage within said drive line by sensing the amount of rotation of a first part of said drive line connected with said motor, sensing the amount of rotation of a second part of said drive line, located on the opposite side of said torque-limiting coupling from said motor, and comparing the respective amounts of slippage of said first and second parts; and (d) temporarily reversing said motor in order to relieve blockage of said machine, in response to slippage within said torque-limiting coupling exceeding a first predetermined amount within a first predetermined amount of time.

7. The method of claim 6, including the further step of observing how many times said motor is temporarily reversed within a given interval of time and interrupting the supply of power to said motor when said motor is temporarily reversed a certain number of times within said given interval.

8. The method of claim 6 wherein said motor is an electric motor, including the step of monitoring the amount of current drawn by said motor and temporarily reversing the direction of said motor in response to said current exceeding an established amount for an established length of time, which is longer than first said predetermined amount of time.

9. The method of claim 8, including the further step of disconnecting said source of power when said amount of slippage exceeds a second predetermined amount, which is less than first predetermined amount, for a second predetermined amount of time, which is greater than said first predetermined amount of time.

10. A method of operating a material comminuting machine of the type having at least a pair of rotary cutter shafts driven by an electrical motor connected with said cutter shaft through a drive line, the method comprising:

(a) measuring the electrical current provided to said motor;

(b) interrupting the supply of current to said motor in response to current exceeding a predetermined amount for a first predetermined amount of time; and (c) permitting slippage within said drive line when torque within said drive line exceeds a certain level for less than said first predetermined amount of time, but interrupting said supply of current to said motor when said slippage continues for a second predetermined amount of time which is longer than said first predetermined amount of time.

11. Apparatus for comminuting materials comprising:

(a) a pair of rotatable cutter shafts having cutter blades affixed thereto which cooperatively interact to shread material;

(b) electric drive motor means for rotatably operating said cutter shafts;

(c) means for measuring the electric current provided to said drive motor means;

(d) means for interrupting the supply of current to said drive motor means when it exceeds a prescribed level for a predetermined period of time;

(e) torque limiting clutch means located between said cutter shafts and said drive motor means for preventing the torque resulting from the jamming of said cutter blades for a time less than said predetermined time from being transmitted to said drive motor means; and (f) means for measuring the amount of slippage in said clutch means and for interrupting the supply of current to said drive motor means when said slippage exceeds a certain level for a defined timed interval.

* * * * *

UNITED STATES PATENT AND TRADEMARK OFFICE

CERTIFICATE OF CORRECTION

PATENT NO. : 4,609,155

DATED : September 2, 1986

INVENTOR(S) : Thomas J. Garnier

It is certified that error appears in the above-identified patent and that said Letters Patent is hereby corrected as shown below:

Col. 3, Line 48 Change "preseht" to --present--

Col. 7, Line 20 After "materials" insert --, of the type--

Signed and Sealed this

Thirteenth Day of January, 1987

*Attest:*

DONALD J. QUIGG

*Attesting Officer*

*Commissioner of Patents and Trademarks*